United States Patent [19]

Olivieri

[11] Patent Number: 4,670,999

[45] Date of Patent: Jun. 9, 1987

[54] FOOT SECURING DEVICE, PARTICULARLY FOR SKI BOOTS

[75] Inventor: Icaro Olivieri, Biadene di Montebelluna, Italy

[73] Assignee: Caber Italia S.p.A., Montebelluna, Italy

[21] Appl. No.: 801,701

[22] Filed: Nov. 25, 1985

[30] Foreign Application Priority Data

Nov. 27, 1984 [IT] Italy ..... 41667 A/84

[51] Int. Cl.[4] ..... A43B 5/04; A43B 11/00

[52] U.S. Cl. ..... 36/119; 36/50

[58] Field of Search ..... 36/117–121, 36/50

[56] References Cited

U.S. PATENT DOCUMENTS

| | | | |
|---|---|---|---|
| 4,160,332 | 7/1979 | Salomon | 36/119 |
| 4,192,087 | 3/1980 | Salomon | 36/119 |
| 4,196,530 | 4/1980 | Delery | 36/119 |
| 4,253,251 | 3/1981 | Salomon | 36/119 |
| 4,611,414 | 9/1986 | Vogel | 36/120 |
| 4,619,057 | 10/1986 | Sartur et al. | 36/50 |

FOREIGN PATENT DOCUMENTS

| | | | |
|---|---|---|---|
| 0146502 | 6/1985 | European Pat. Off. | 36/119 |
| WO85/03207 | 8/1985 | World Int. Prop. O. | 36/119 |

*Primary Examiner*—James Kee Chi

[57] ABSTRACT

The device comprises hollow frusto-conical elements adapted for enveloping a ski boot inner shoe and/or in combination also a ski boot shell. The frusto-conical elements are adapted to be pulled toward the rear portion of a boot. To this end, each frusto-conical element is associated with a small adjustable length cable by means of devices positionable externally on a bootshell, which devices are adapted to place the small cables themselves under tension.

14 Claims, 13 Drawing Figures

FOOT SECURING DEVICE, PARTICULARLY FOR SKI BOOTS

BACKGROUND OF THE INVENTION

The subject of the present invention is a foot securing device, particularly for ski boots.

It is known that with particular footwear, such as ski boots, it is necessary, both for the athlete's safety and to be able to control the skis which are attached to the boots themselves, that the foot be well secured against movement or internal looseness.

On the other hand, for comfort, it is necessary that the boot compresses the foot as evenly as possible, without areas of excessive compression and areas of looseness on the foot itself.

Areas of excessive compression cause, in fact, pain or discomfort, whilst those areas where the foot is loose do not cooperate in transferring the stresses to the implements, giving the athlete instead a feel of unsafety and instability.

To solve this problem, many devices have been developed which, in general, may be classed as external devices and internal devices.

To the first class belong all the various adjustable levers which, being associated with the boot shell additionally to closing it make it possible to locally pull the shell flaps with a greater or lesser force such that this effect is also reflected on the inner shoe and hence also on the foot.

That adjustment is not very effective because it is of substantially indirect type in that the foot compression can only take place by deformation of the boot shell.

Among the internal devices, known are ties or small cables which act substantially on the foot instep of the inner shoe and which are connected through force adjustment means to a pair of fixed points rigid with the inner portion of the boot shell.

Also in this case there are many drawbacks, particularly due to the fact that the foot compression takes place at particularly restricted areas with an uneven securing effect.

Other devices provide for lifting or lowering an inner wedge heel, consequently decreasing the shell's inside volume, but also in this case foot securing is still achieved by tightening a set of external linkages.

In this case the device is inconvenient to adjust in addition to not being particularly effective.

It should be also noted that there is considerable difficulty in devising a perfect tightening device, because the feet of each person have a different anatomical configuration.

SUMMARY OF THE INVENTION

It is an aim of the present invention to provide a foot securing device particularly for ski boots which, by virtue of its design and operation, can overcome the drawbacks encountered in the prior devices.

A consequent primary object of the invention is to provide a foot securing device adapted to press and secure the foot within the shell of a ski boot such that the securement occurs over broad, practically nonlocalized, areas of the foot.

Another object is to provide a foot securing device which is easily adjusted to fit different anatomical configurations of the foot.

A further object is to provide a foot securing device, particularly for ski boots, the adjustment, actuation and release whereof are by means located at the exterior of the shell.

An even further object is to provide a foot securing device with multiple adjustments which are actuatable and regulatable by either single or combined easily operable external means.

A not least object is to provide a foot securing device which may be integrated, as far as its actuation is concerned, to securing devices already present on ski footwear.

These and other objects which will become apparent from the following description, are achieved by a foot securing device, particularly for ski boots, characterized in that it comprises at least one cable, having at least one end and at least one other end, adjustment linkage means and at least one hollow frusto-conical element adapted for enveloping at least the inner shoe portion of a footwear item, said hollow frusto-conical element being moveable by means of said cable associated at one end with the frusto-conical element itself and at the other end with said adjustment linkage means, rigidly associable with a boot shell, means being provided for adjusting and setting the length of said at least one cable, and for guiding said at least one hollow frusto-conical element.

BRIEF DESCRIPTION OF THE DRAWINGS

Further features and advantages of the invention will become apparent from the following detailed description of some embodiments thereof, given herein by way of illustration and not of limitation with reference to the accompanying drawing sheets, where.

DESCRIPTION OF THE PREFERRED EMBODIMENTS

Figure 1:
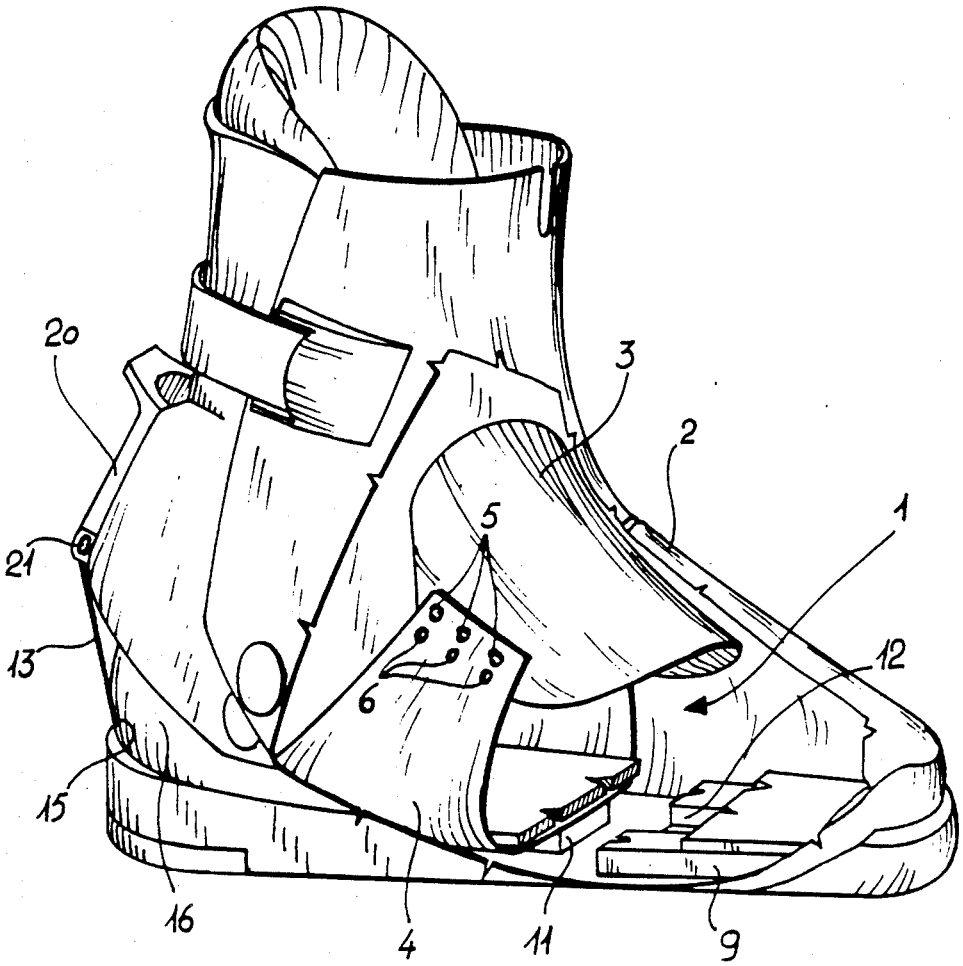
FIG. 1 is a partially cut-away perspective view of a ski boot equipped with a foot securing device according to the invention.
Figure 2:
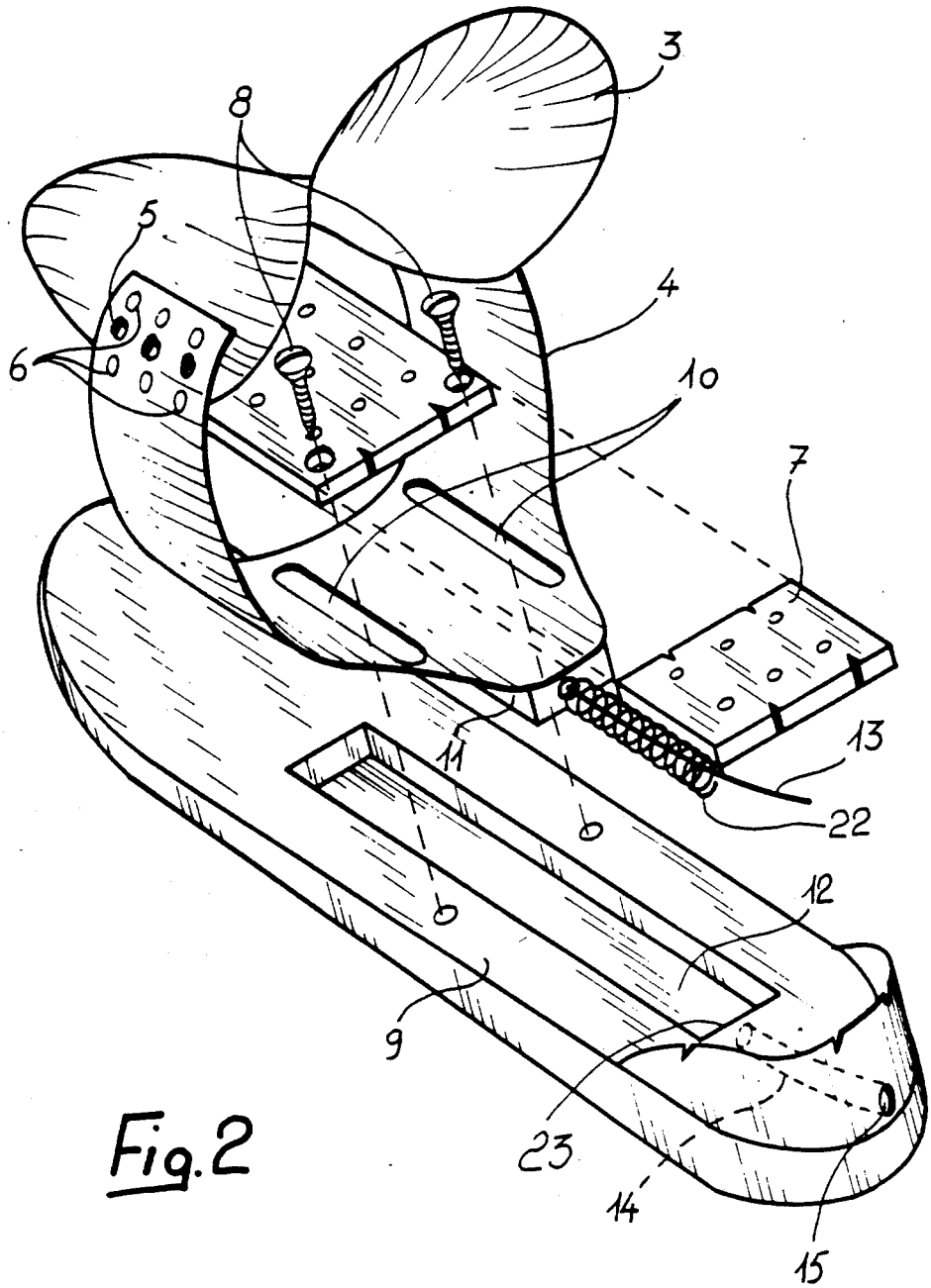
FIG. 2 is an exploded perspective detail view of the foot securing device of FIG. 1.

With reference to the above cited drawing figures, the invention, in a first embodiment thereof, comprises a frusto-conical element 1 defining a foot retention element insertable into the shell of a ski boot 2 and comprising an arcuate body 3 shaped to match, in the illustrated example, the foot instep of the inner shoe not shown in the figure, and being associated with a lower band 4, thereby in combination the arcuate body 3 and the lower band 4 define a sleeve-like element of frusto-conical geometric form.

The lower band 4 is associated with the arcuate body 3 by means of a plurality of nibs 5, rigidly associated in the illustrated instance with the arcuate body 3 and which can be selectively fitted into a like plurality of holes 6, of which there are several side-by-side groups, so as to permit a first adjustment to be made according to the wearer's foot on which the boot is to be adjusted.

Said lower band 4 in addition to containing the soft inner boot or shoe not shown, also advantageously embraces a rigid insole 7 which is attached by screws 8 or other equivalent devices to the wedge shaped sole or wedge heel 9 of the ski boot 2.

In order to let the frusto-conical element 1 translate freely, said rigid insole 7 forms an ideal bridge over the wedge 9 so as to leave room for the lower band 4.

Said lower band 4, also expediently has at a bottom portion thereof two longitudinal slots 10 wherethrough said screws 8 are passed so as to allow displacement of said frusto-conical element 1, which may slide between and relatively to the wedge 9 and the insole 7 for a distance corresponding to the longitudinal extension of the slots 10.

In the lower middle zone of said lower band 4 there is provided a longitudinal parallelepipedal boss 11 which extends preferably over the entire length of the lower band 4 and fits into a correspondingly shaped longitudinal groove 12 provided in the middle zone of the upper surface of the wedge 9.

The parallelepipedal boss 11 is accommodatable in the longitudinal groove 12, which has substantially the same dimensions, with necessary clearances, so as to permit the boss 11 to be guided during the forward or rearward translation movements of said frusto-conical element 1.

The combination of the parallelepipedal boss 11 with the longitudinal groove 12 allows the frusto-conical element 1 to be guided without moving angularly, just as the rigid insole 7 prevents inclinations or tilting of the frusto-conical element 1 to only permit conclusion of a translatory or substantially linear sliding motion.

On said parallelepipedal boss 11 there is secured a small flexible cable 13 which is first guided into a channel 14 and then exits through a hole 15 located in the heel region 16 of the shell of the ski boot 2.

The end of the flexible cable 13 is associated with an adjustment means 17 comprising a screw 18 which may be threaded into a tiltable cross-piece 19 advantageously associated with a lever 20 at an off-centre position with respect to the fulcrum point 21 whereat the lever 20 is attached to the shell 2 of the ski boot.

The association of the screw 18 with the flexible cable 13 is expediently arranged such that the screw 18 can turn without twisting the cable 13, for example, by the interposition of a conventional swivel connector.

Figure 3:
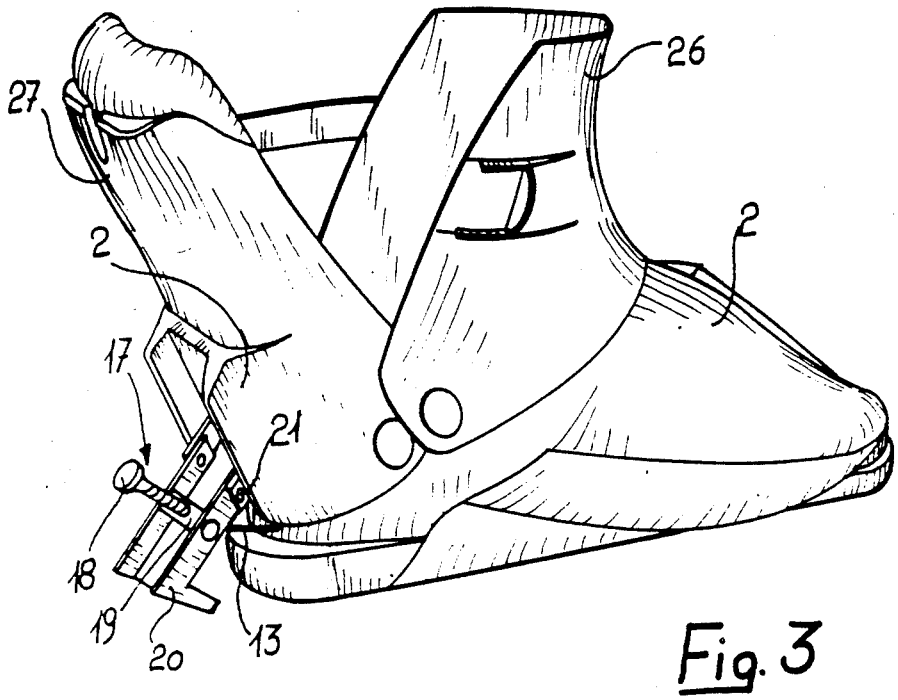
FIG. 3 is a perspective rear view of a ski boot equipped with a foot securing device according to the invention showing the cable adjustment and pulling means.
Figure 4:
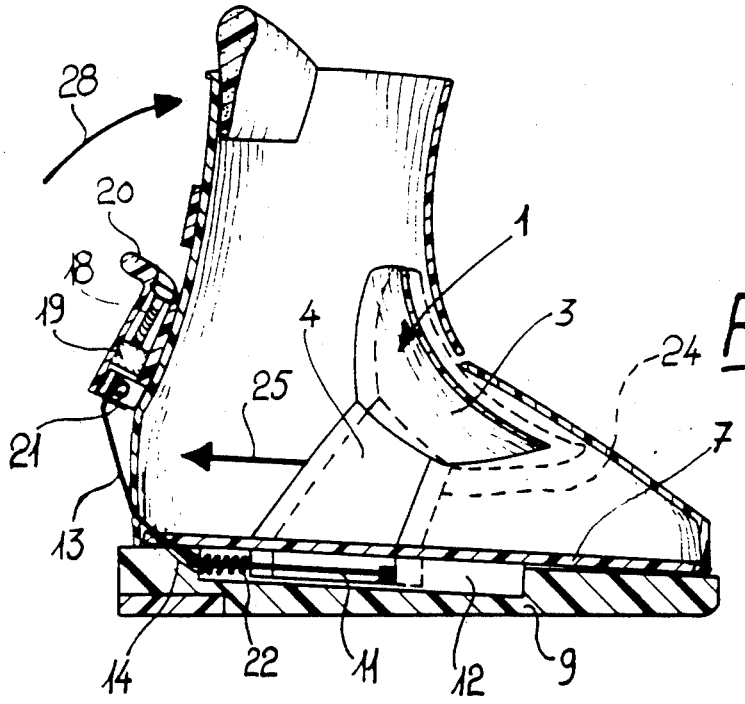
FIG. 4 is a partially sectional view taken on the longitudinal mid-axis of a ski boot equipped with the foot securing device according to the invention illustrating its mode of operation.

With the lever 20 opened as in FIG. 3, the cable is unstressed and a cylindrical spring 22 may be inserted into the groove 12 and encircling the cable 13 so as to act between the rear wall 23 of the groove 12 and the parallelepipedal boss 11, thereby holding the frusto-conical element 1 urged forwardly to the position indicated in broken lines at 24 in FIG. 4.

On closing the lever 20 as shown in FIG. 4, the cable 13 applies a pulling force and the frusto-conical element 1 is drawn backwards in the direction of the arrow 25 in FIG. 4.

If the boot is conveniently of the rear opening type, that is with a quarter divided into two parts, respectively a front quarter 26 and rear quarter 27, then after carrying out the calibration by rotating the screw 18, the lever 20 may be left always closed and the actuation of the frusto-conical element 1 takes place in closing the rear of the quarter 27, that is during the closure movement of the same schematically indicated by the arrow 28 in FIG. 4.

The operation of the device illustrated is evident from both its structure and the description given above.

In practice, the frusto-conical element 1 encircles the ski boot's inner shoe and by adjusting its position one can obtain a desired compression on the wearer's foot, with a reliable securement of the foot itself on the interior of the ski boot.

Adjustment is made by regulation of the length of the cable 13 which may be effected either with the boot opened or with the boot closed, in the latter case by simply opening the lever 20, and thereafter rotating the screw 18.

It should be noted that the frusto-conical element 1 moves by translation toward the rear portion of the boot to thus act on a broad zone of the foot instep as well as on the side portions of the foot itself.

With boots of the rear entrance type, once the adjustment has been made, it will be no longer necessary to intervene, it being sufficient to close the quarter with the usual devices to also simultaneously obtain securement of the foot in the ski boot.

Anyhow, it is still possible in this case, even with the boot closed, to intervene on the adjustment screw 18 by simply opening the lever 20.

Figure 5:
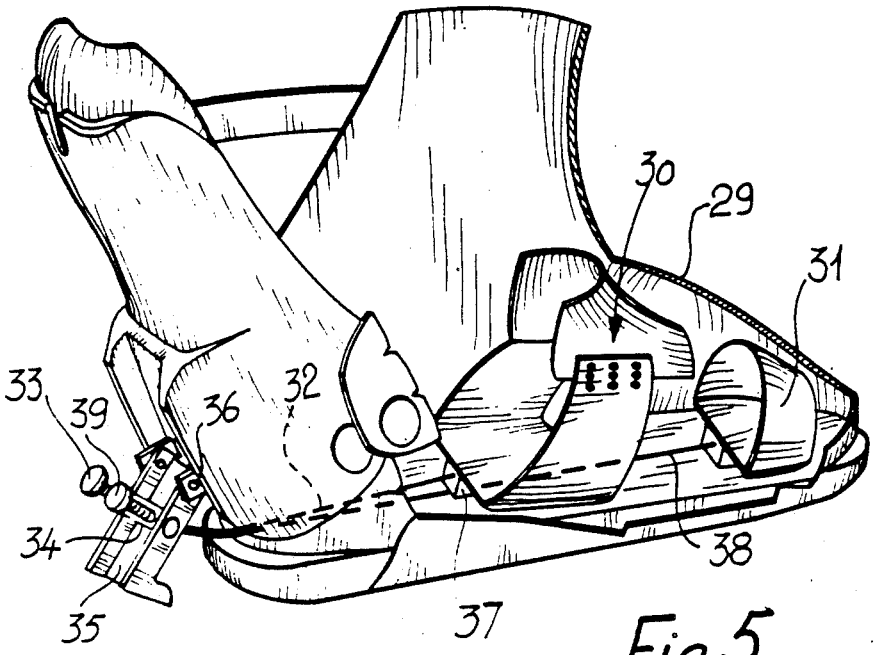
FIG. 5 shows a first variation of the device according to the invention showing two open frusto-conical elements, actuable independently of each other.

In FIG. 5 there is illustrated another embodiment of the same inventive concept.

In this case, within a boot now indicated at 29, there are contained two open frusto-conical elements, respectively a middle one 30 and front one 31, the former acting on the foot intep and the latter on the forward region of the foot itself.

Said first middle frusto-conical element 30 is disconnected by means of a first cable 32 and a first adjustment screw 33 threaded on a tilting cross-piece 34 mounted on a lever 35 pivoted at 36 on the rear portion of the boot 29.

Also in this case the middle frusto-conical element 30 has at the bottom a parallelepipedal boss 37 having the same purpose and the same functions as the element indicated at 11 in the embodiment already described.

The front frusto-conical element 31 is in turn associated by a second cable 38 with a second adjustment screw 39 also threaded on said tilting cross-piece 34 of the lever 35.

In this case one can intervene individually, by adjusting the pressure on both the foot instep and the toe zone of the footwear.

The adjustments are made in an independent manner and once carried out a single movement of the lever 35 brings simultaneously to a desired compressive situation on both the middle and forward portions of the foot.

Thus, it is possible to secure within the boot a wearer's foot having any anatomic conformation.

Figure 6:
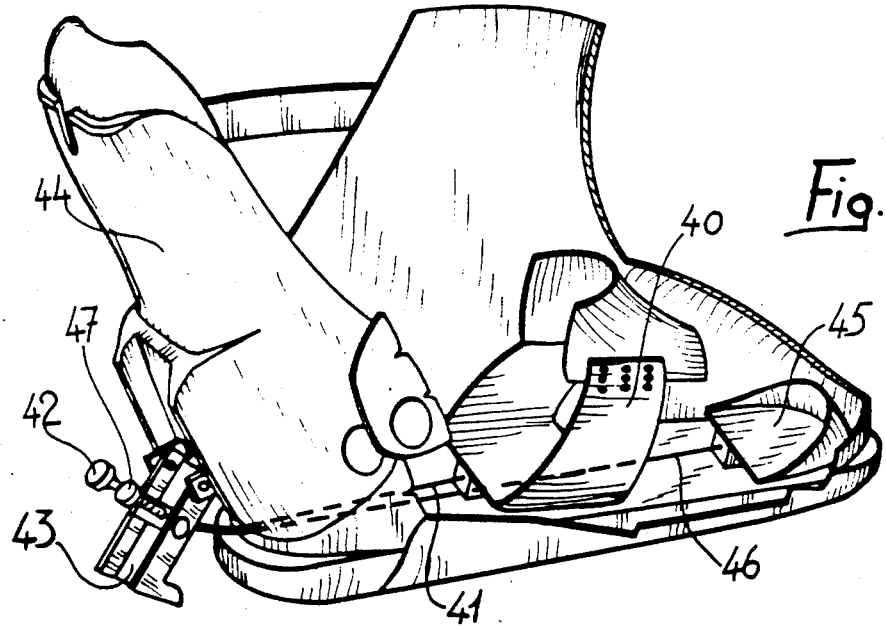
FIG. 6 is a partly cut-away perspective view illustrating a further embodiment of the invention showing the combination of an open frusto-conical element and a toe piece, both being adjustable.

In FIG. 6 there is shown a further embodiment of the same inventive concept.

In this case there is provided an open frusto-conical element now indicated at 40 and located in the middle region of the footwear and associated by a first cable 41 with an adjustment screw 42 mounted in the manner already described on a lever 43 pivoted on the rear portion of a ski boot 44.

Again present is a front toe piece 45 associated with a second cable 46 which is connected to a second adjustment screw 47 also mounted on the lever 43.

With that configuration the device allows adjustment of the pressure on the foot instep of the person wearing the boot and again adjustment of the fit, that is the realization of a front abutment zone for the toes.

Also in this case the adjustments are fully independent of one another and only the securement on completion of the adjustment occurs by either closing the lever 43 or closing the boot where this is of the rear entrance kind with the quarter split in two parts.

Figure 7:
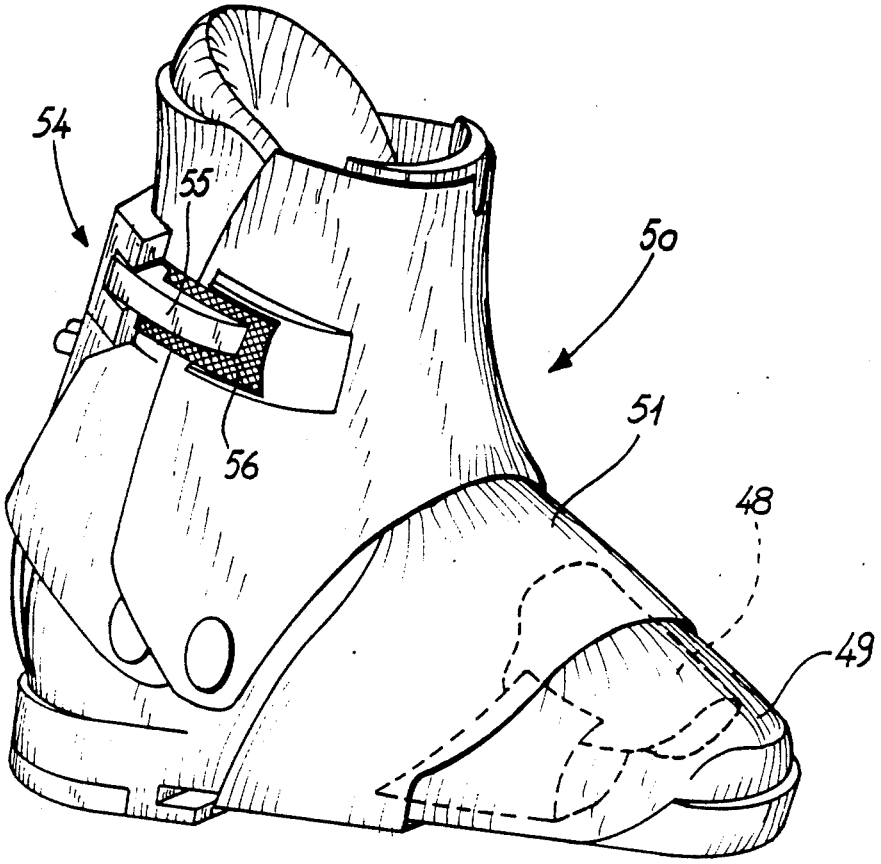
FIG. 7 is a perspective view of a ski boot incorporating a foot securing device according to the invention which combines together two open frusto-conical elements, located respectively on the inside and the outside of the boot shell, the former being shown in broken lines.
Figure 8:
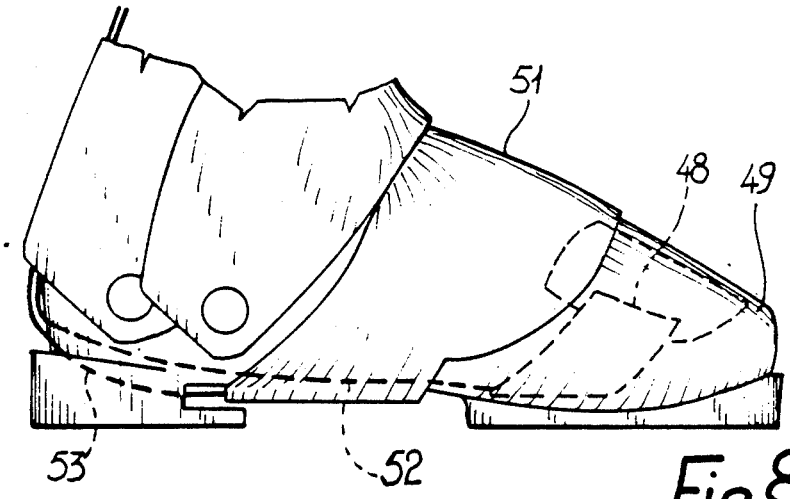
FIG. 8 is a fragmentary side view of the ski boot of FIG. 7.

In FIGS. 7 and 8 there is shown another embodiment of the invention.

In this case there is the combination of an open frusto-conical element now indicated at 48 inserted into the shell 49 of a ski boot 50, with a second frusto-conical outer element 51 which encircles the shell 49 of the ski boot 50 at the exterior thereof.

The outer frusto-conical element 51 is located substantially at the foot instep of the boot 50, whereas the inner frusto-conical element 48 is located preferably on the forward or toe portion of the foot, which portion is unaffected by the outer frusto-conical element 51.

The two elements are each connected respectively to a first cable 52 for the inner element 48 and a second cable 53 for the outer element 51.

Expediently, the two cables 52 and 53 are led to the same tightening device 54 which by means of a lever 55 is adapted to put under tension an annular band 56 which encircles the quarter of the boot 50 accomplishing the closure when tensioned.

Obviously, in all of the illustrative embodiments of the invention described herein, it will be appreciated that the cables may be expediently routed through the wedge heel of the footwear, wherein suitable channels may be expediently formed. Furthermore, such cables may exit the channels at suitably located holes, formed at the heel region of the boot which may advantageously present a rounded profile whereover the cable may slide as the device is actuated.

In FIGS. 9 to 12 there are exemplified the various types of levers and adjustment and tightening devices.

Figure 9:
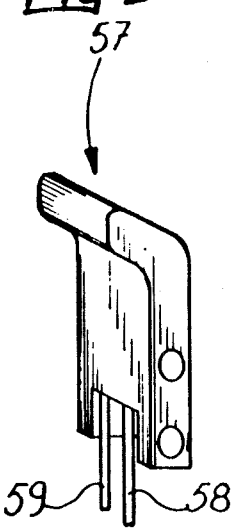
FIG. 9 is a perspective view of a single lever for actuating two cables.

More particularly, FIG. 9 shows a single lever 57 which contains a dual adjustment screw device of the type already illustrated and to which are led two cables 58 and 59, respectively.

In this case on closing the lever 57 there occurs simultaneous tensioning of both cables 58 and 59.

Figure 10:
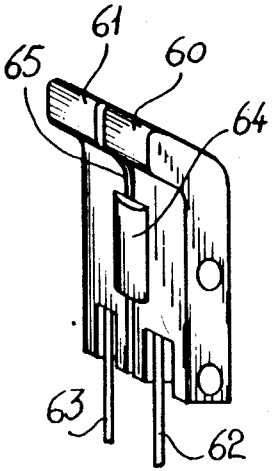
FIG. 10 is a perspective view of dual levers, arranged side-by-side and each being adapted for actuating one cable.

In FIG. 10 there are shown a pair of side-by-side levers now indicated at 60 and 61 both equipped individually with an adjustment device, respectively for two cables 62 and 63.

Expediently, the lever 61 has a lug 64 disposed on the side 65 flanking the lever 60 and partly overlapping the lever 60 itself In this case by acting on the lever 61 alone there occurs the simultaneous closure of the lever 60 as well.

The two levers are independent in adjustment and in their actuation, once the adjustments are carried out, the closure may be effected by actuating one lever only, that is the lever having the lug.

Figure 11:
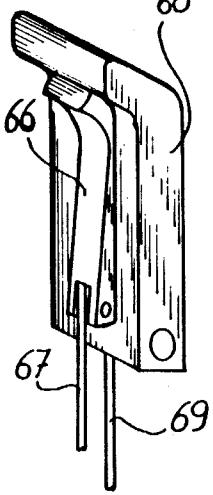
FIG. 11 is a perspective view of a pair of superimposed levers each being adapted for actuating one cable.

FIG. 11 shows a further version wherein a first lever 66 for adjusting and actuating a cable 67 is mounted on a second lever 68 which in turn adjusts and pulls a cable 69.

Also in this case, after carrying the adjustments individually, to effect the closure it will be sufficient to act on just the lever 68, whilst it is still subsequently possible to intervene on the lever 66 to vary the adjustment controlled thereby.

Figure 12:
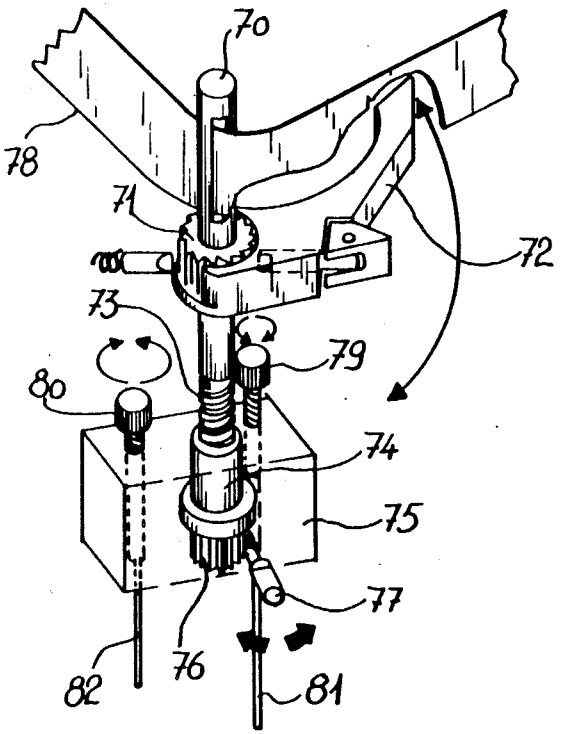
FIG. 12 is a fragmentary perspective view of a device for actuating a pair of cables, associated with a foot instep securing member.

In FIG. 12 there is shown an adjustment and pulling device integrated to the closure device for a boot quarter.

The device illustrated is composed of a vertical axis 70 provided at a middle zone with an inclined tooth gear 71 whereon ratchet lever 72 acts in the manner already illustrated in prior U.S. patent application Ser. No. 06/738.338 by this same Applicant.

Downwardly the axis 70 has a threaded zone 73 which engages in a threaded sleeve 74 contained within a block 75 where it is free to rotate but not to translate.

Said sleeve also has a gear 76 worm 77 coupling by the actuation whereof it is possible to effect a first adjustment of the block 75 independently of the rotation of the vertical axis.

Upwardly the vertical axis 70 in its rotation winds a belt 78 which causes the boot's quarters to be brought together to a position of closure.

On the block 75 there are threaded two adjustment screws 79 and 80, respectively, whereto there are connected respectively the first ends of cables 81 and 82 the second ends whereof are rigidly associated with one of the frusto-conical elements illustrated.

With the device shown in FIG. 12, after carrying out a pre-calibration by means of the screws 79 and 80, tightening of all the parts making up the boot is accomplished by merely actuating the lever 72.

The worm 77 further allows the pressure of the cones to be increased or decreased accordingly with respect to the closure tension of the boot quarter.

Figure 13:
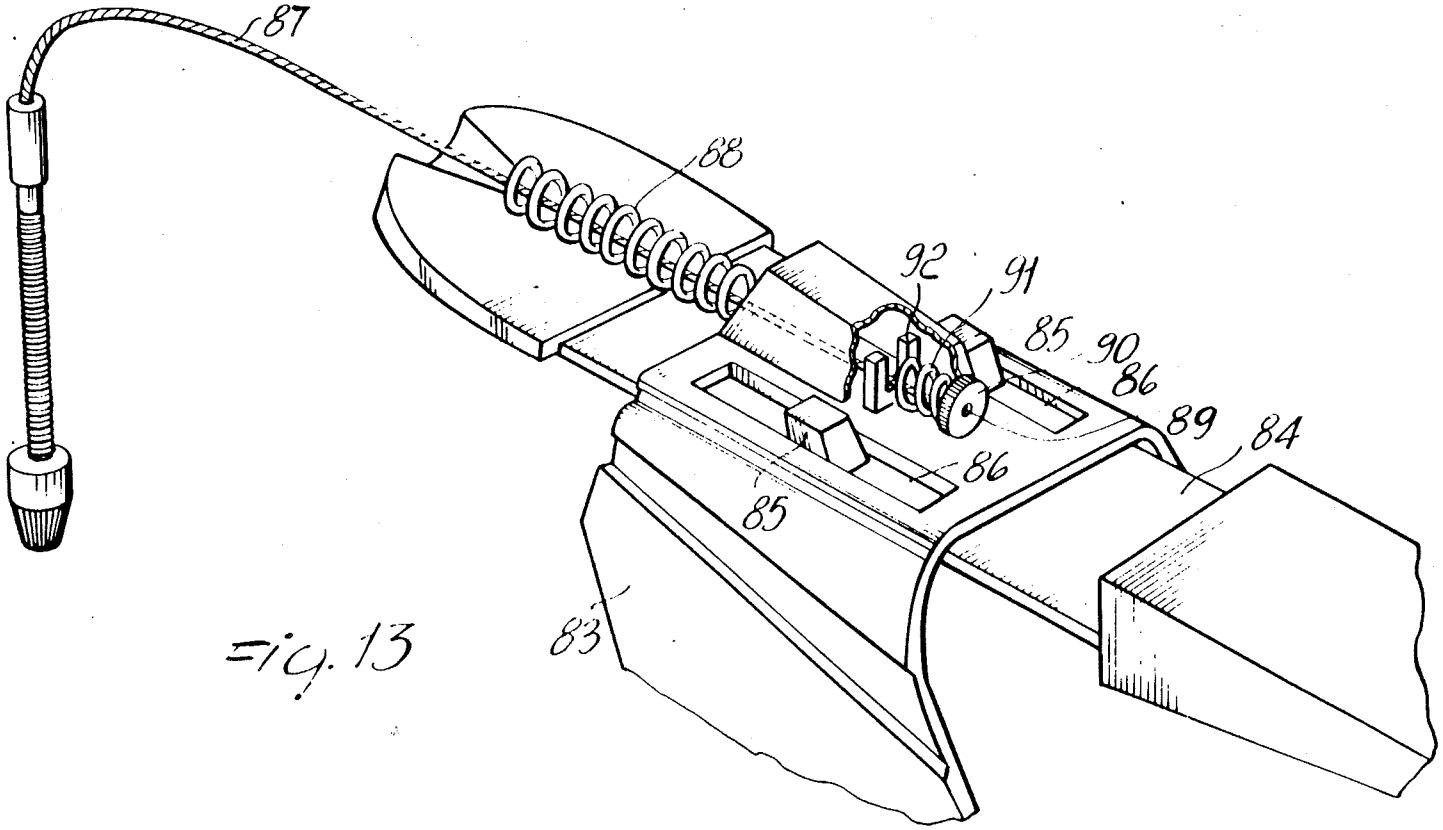
FIG. 13 is a fragmentary perspective view of a further embodiment of the foot securing device according to the invention.

FIG. 13 shows a further embodiment of the invention: according to this embodiment, the frusto-conical element 83 is also inserted below the rigid insole 84 which is rigid with the rigid structure of the boot.

Said insole 84 has in its bottom face two nibs 85 which are inserted into two longitudinal openings 86 formed on the side of the frusto-conical element 83 which extends below the rigid insole 84.

The frusto-conical element 83 can thus translate being guided by the nibs 85, owing either to the pull of the cable 87 during the closure step, or to the thrust of the spring 88 during the opening step.

The end 89 of the cable has a widened termination 90, and the cable 87 is passed, with the interposition of a spring 91, through a yoke-like anchor 92 rigid with the frusto-conical element 83.

Thus, the association of the cable 87 with the frusto-conical element 83 is not a rigid one, but the spring 91 tends to compensate elastically for the stresses transferred by the foot to the footwear. The spring 91 also enables the foot to be secured rather than by a rigid clamping action, by an elastic clamping action which is preloaded by the adjustment systems already described.

It may be seen from the foregoing illustrations and descriptions that the invention's objects have been achieved, and in particular that a device has been provided which is capable, in its different embodiments, of adapting itself perfectly to any foot configuration, securing it by the actuation of simple external linkages.

The particular translating cone shape allows broad areas of the foot to be involved so as not to generate localized loads which would cause discomfort or inconvenience.

The control assembly is reduced to few, very simple and particularly strong, component parts.

Of course, based on the same inventive concept, other different embodiments are possible which all fall within the scope of the present patent.

Of course, the materials and dimensions may be any ones according to necessity.

From the foregoing, it will be apparent that the following features of the invention considered either singly or in combination have patentable merits;

a foot securing device, particularly for ski boots wherein said arcuate element defines in joining said lower band an open truncated cone for embracing the boot's soft inner shoe;

a device wherein a flexible cable is attached at one end to said parallelepipedal boss and at the other comes out of the boot and is connected to adjustment and securement means rigid with the boot shell;

a device wherein said cable is anchored elastically on said frusto-conical element;

a device wherein said elastic anchor for the cable on the frusto-conical element is accomplished by interposing a compression cylindrical spring to the cable end provided with a widened termination and a yoke-like anchor rigid with the frusto-conical element;

a device wherein said adjustment means comprise substantially a lever pivoted on the boot shell, on said lever at an off-centered zone with respect to the pivot, there being present a tilting cross-piece wherewith there are associated screw means connected each to one cable;

a device wherein rotation of said screw means relatively to said tilting cross-piece determines the free length between the point of attachment of the cable on the frusto-conical element and the lever pull point;

a device wherein during the cable tension, the frusto-conical element wherewith it is associated moves by rectilinear translation toward the rear portion of the boot any rotation being prevented by the guide devices present comprising the combination of said rigid insole and the groove on the wedge;

a device further comprising a return spring inserted between a point formed on the wedge and said parallelepipedal boss present on the frusto-conical element;

a device wherein said spring is of the cylindrical type and contained in said guide groove whilst the tension cable of the frusto-conical element is passed through its interior;

a device wherein at least one adjustment device of each cable is mounted individually on an independent clamping lever;

a device comprising two side-by-side adjustment and clamping levers, one of them having a device adapted to engage with the second, said device allowing a single closure operation for the lever pair;

a device wherein said axis is further associated with a band which winds or unwinds therefrom, said band embracing the boot quarter and determining its tightening or opening;

a device comprising a single lever externally of the shell of the boot which determines the rotation of said axis, said rotation determining simultaneously both the clamping of the boot shell and the inner clamping of the foot by translation of said frusto-conical elements.

I claim:

1. In a footwear item, particularly a ski boot, including a rigid shell defining a shell outer surface, a shell inside, a shell instep portion, a bottom wedge and a heel zone, a foot securing device comprising:

at least one sleeve-like, substantially frusto-conical foot retention element arranged in said shell inside for enveloping a user's foot substantially at said shell instep portion, said foot retention element comprising an upper arcuated member extending at said shell instep portion and a lower member extending transversely on said bottom wedge for encircling a user's foot sole, said upper arcuated member and said lower member being mutually mechanically connected;

at least one tension cable having a middle portion and first and second ends, said first end of said tension cable being connected to said foot retention element, said middle portion extending at least partially in said rigid shell and said second end of said tension cable protruding from said rigid shell;

adjustment linkage means rigidly mounted on said shell outer surface and connected to said second end of said tension cable for tensioning said tension cable, said adjustment linkage means including at least one cable length adjustment means; and translation guide means comprising a first guide member in said rigid shell and a second guide member in said foot retention element, said first and second guide members mutually cooperating for guiding said foot retention element substantially parallel to said bottom wedge, thereby, when said tension cable is tensioned through said adjustment linkage means, said foot retention element is caused to slide within said rigid shell substantially parallel to said bottom wedge towards said heel zone and to slide on a user's foot.

2. A device according to claim 1, wherein said upper arcuated member is shaped to mate a user's foot and said lower member comprises a band, said upper arcuated member and said lower band being mutually connected by adjustable engagement devices.

3. A device according to claim 1, wherein said wedge defines a guide groove and said foot retention element comprises a parallelepipedal middle boss projecting downwardly in said guide groove and being rigidly secured to said first end of said tension cable.

4. A device according to claim 1, comprising elastic means. arranged in said bottom wedge and acting on said foot retention element for urging said foot retention element away from said heel zone.

5. A device according to claim 1, wherein said first end of said tension cable is connected to said foot retention element through elastic means.

6. A device according to claim 1, further comprising a rigid insole overlapping and being rigidly associated with said wedge by connecting devices, said rigid insole being held apart from said wedge by a distance accomodating said lower member of said foot retention element and allowing for free translatory movement of said lower member of said foot retention element.

7. A device according to claim 1, wherein said at least one cable length adjustment means is carried by a small block having on its inside a threaded sleeve, said threaded sleeve accomodating a threaded axis, thereby, rotation of said threaded axis determines translation of said small block for selectively tensioning and relaxing said tension cable.

8. A device according to claim 1 further comprising a second substantially frusto-conical foot retention element arranged proximate to and in succession with respect to said at least one foot retention element, said second foot retention element being connected to a first end of a second tension cable independent from said at least one tension cable, said second tension cable having a second end connected to second cable length adjustment means supported on said rigid shell and being independent from said at least one cable length adjustment means.

9. A device according to claim 8, wherein said second foot retention element is arranged at a foot toe zone of said rigid shell.

10. A device according to claim 8, wherein said at least one cable length adjustment means and said second cable length adjustment means are supported on a single actuating lever pivotally mounted on said rigid shell.

11. A device according to claim 8, wherein a first adjustment and clamping lever carrying said at least one cable length adjustment means is pivotally mounted on a second adjustment and clamping lever carrying said second cable length adjustment means, thereby movement of said second lever also determining movement of said first lever.

12. A device according to claim 8, wherein said second substantially frusto-conical foot retention element is closed at an end thereof.

13. A device according to claim 8, wherein said second foot retention element is located at said shell foot instep zone outside of and enveloping said rigid shell.

14. In a foot wear item, particularly a ski boot, including a rigid shell and a soft inner shoe, inside said rigid shell, a foot securing device according to claim 1 wherein said at least one foot retention element is arranged between said ridig shell and said soft inner shoe.

* * * * *